US007740131B2

(12) United States Patent
Marcello

(10) Patent No.: US 7,740,131 B2
(45) Date of Patent: Jun. 22, 2010

(54) CASE FOR MAINTAINING INSIGNIA AND ARTICLES RELATED TO UNIFORM

(76) Inventor: Dennis Marcello, 337 CO RT 75, Sackets Harbor, NY (US) 13685

( * ) Notice: Subject to any disclaimer, the term of this patent is extended or adjusted under 35 U.S.C. 154(b) by 665 days.

(21) Appl. No.: 11/735,712

(22) Filed: Apr. 16, 2007

(65) Prior Publication Data

US 2007/0246389 A1 Oct. 25, 2007

Related U.S. Application Data

(60) Provisional application No. 60/745,135, filed on Apr. 19, 2006.

(51) Int. Cl.
*A45C 15/00* (2006.01)

(52) U.S. Cl. ..... 206/38; 206/473

(58) Field of Classification Search ..... 206/472, 206/473, 37, 38, 232
See application file for complete search history.

(56) References Cited

U.S. PATENT DOCUMENTS

| | | | | |
|---|---|---|---|---|
| 4,316,492 | A | 2/1982 | Plough et al. | |
| 4,720,012 | A * | 1/1988 | Dufour | 206/472 |
| 5,283,966 | A | 2/1994 | Rader et al. | |
| 5,363,953 | A | 11/1994 | Carter | |
| 5,797,528 | A | 8/1998 | McDuffie | |
| 6,012,575 | A * | 1/2000 | Eskandry | 206/308.1 |
| 6,161,979 | A * | 12/2000 | Yamamoto et al. | 402/73 |
| 6,237,756 | B1 | 5/2001 | Caudle | |
| 6,758,335 | B2 * | 7/2004 | Kajiya | 206/320 |
| 6,923,357 | B2 | 8/2005 | Smith | |
| 7,021,853 | B2 * | 4/2006 | Hall et al. | 402/73 |
| 7,331,461 | B2 * | 2/2008 | MacKinnon | 206/553 |
| 2005/0133559 | A1 | 6/2005 | Daves | |

OTHER PUBLICATIONS http://shop/sayreinc.com/proddet.php?IDArt=1814, Sayre's Military/Tactical Store—Rank and Patch Holder, *Army Patch Pouch*, last printed Apr. 17, 2007, 1 page.

* cited by examiner

*Primary Examiner*—Jacob K Ackun, Jr.
(74) *Attorney, Agent, or Firm*—Woodard, Emhart, Moriarty, McNett & Henry LLP

(57) ABSTRACT

A case for maintaining insignia and other articles associated with a uniform includes an outer cover and an inner surface, and is configured to fold about a center fold. The case includes an inner panel for attaching and carrying uniform articles and an inner pouch for carrying loose items. The flap and the pouch are each attached along one side to the inner surface of the case near the center fold. The case has a plurality of inner attachment surfaces, which includes the inner surface of the case, the side surfaces of the panel, and the outer surfaces of the pouch. At least one of the attachment surfaces includes a section having hook and loop fasteners to engage uniform badges having hook and loop fasteners. Additionally, at least one of the attachment surfaces includes foam backing configured to receive at least one uniform pin.

8 Claims, 3 Drawing Sheets

CASE FOR MAINTAINING INSIGNIA AND ARTICLES RELATED TO UNIFORM

REFERENCE TO RELATED APPLICATION

The present application claims the benefit of U.S. Provisional Patent Application Ser. No. 60/745,135 filed Apr. 19, 2006 entitled "CASE FOR MAINTAINING INSIGNIA AND ARTICLES RELATED TO UNIFORM" which is hereby incorporated by reference in its entirety.

FIELD OF THE INVENTION

The present invention generally relates to carrying cases, and more specifically to cases for maintaining insignia, badges, pins and other articles related to a uniform.

BACKGROUND

Uniforms are used in conjunction with numerous trades and professions. Many, if not all, uniforms must be cleaned or laundered in some fashion. Additionally, numerous uniforms have articles associated therewith, requiring removal of the articles before cleaning or laundering the uniform. Often times the articles removed from the uniform include badges, pins, and/or loose items such as coins, etc. There remains a need for an organized way to maintain the articles removed from a uniform. Additionally, there remains a need for an apparatus to secure and maintain the removed articles in an organized manner.

SUMMARY

In one embodiment, a case for carrying and maintaining articles associated with a uniform includes an outer cover and an inner surface. The case is configured to fold about a center fold and includes at least one inner panel for carrying uniform articles and at least one inner pouch for carrying loose items. The panel and the pouch are each attached along one side to the inner surface of the case adjacent the center fold. Accordingly, the case includes a plurality of inner attachment surfaces including at least the inner surface of the case, the side surfaces of the panel, and the outer surfaces of the pouch. At least one of the attachment surfaces includes a section having hook and loop fasteners to engage uniform badges having hook and loop fasteners. Additionally, at least one of the attachment surfaces includes foam backing configured to receive at least one uniform pin.

In another embodiment, a case for maintaining articles related to a uniform comprises an outer cover including an outer fold portion between first and second outer cover surfaces, a zipper connecting the outer cover surfaces along three sides, and first and second inner cover surfaces opposite the first and second outer cover surfaces. The inner cover surfaces are separated by an inner fold portion. At least one of the inner cover surfaces includes at least one attachment piece having hook and loop fasteners configured to receive at least one uniform article having hook and loop fasteners. Additionally, a foam piece is positioned between an inner cover surface and the corresponding outer cover surface, such that the inner cover surface having the foam backing may receive at least one uniform pin. Additionally, the case includes an inner flap attached to the inner fold portion and positioned between the inner cover surfaces. The inner flap includes at least one attachment piece having hook and loop fasteners configured to engage at least one uniform article having hook and loop fasteners. The case further includes an inner pouch attached to the inner fold portion to maintain loose items, with at least one of the outer surfaces of the pouch having a pocket positioned thereon.

In yet another embodiment, a method for maintaining articles removed from a uniform comprises removing a badge having hook and loop fasteners from the uniform, attaching the badge to a hook and loop fastener attachment piece in a uniform patch case. Additionally, the method includes removing at least one pin from the uniform and attaching the pin to an inner foam-padded surface in the uniform patch case. The method further includes removing at least one loose item from the uniform and placing the loose item in an inner pouch of the uniform patch case.

DESCRIPTION OF THE ILLUSTRATED EMBODIMENTS

Figure 1:
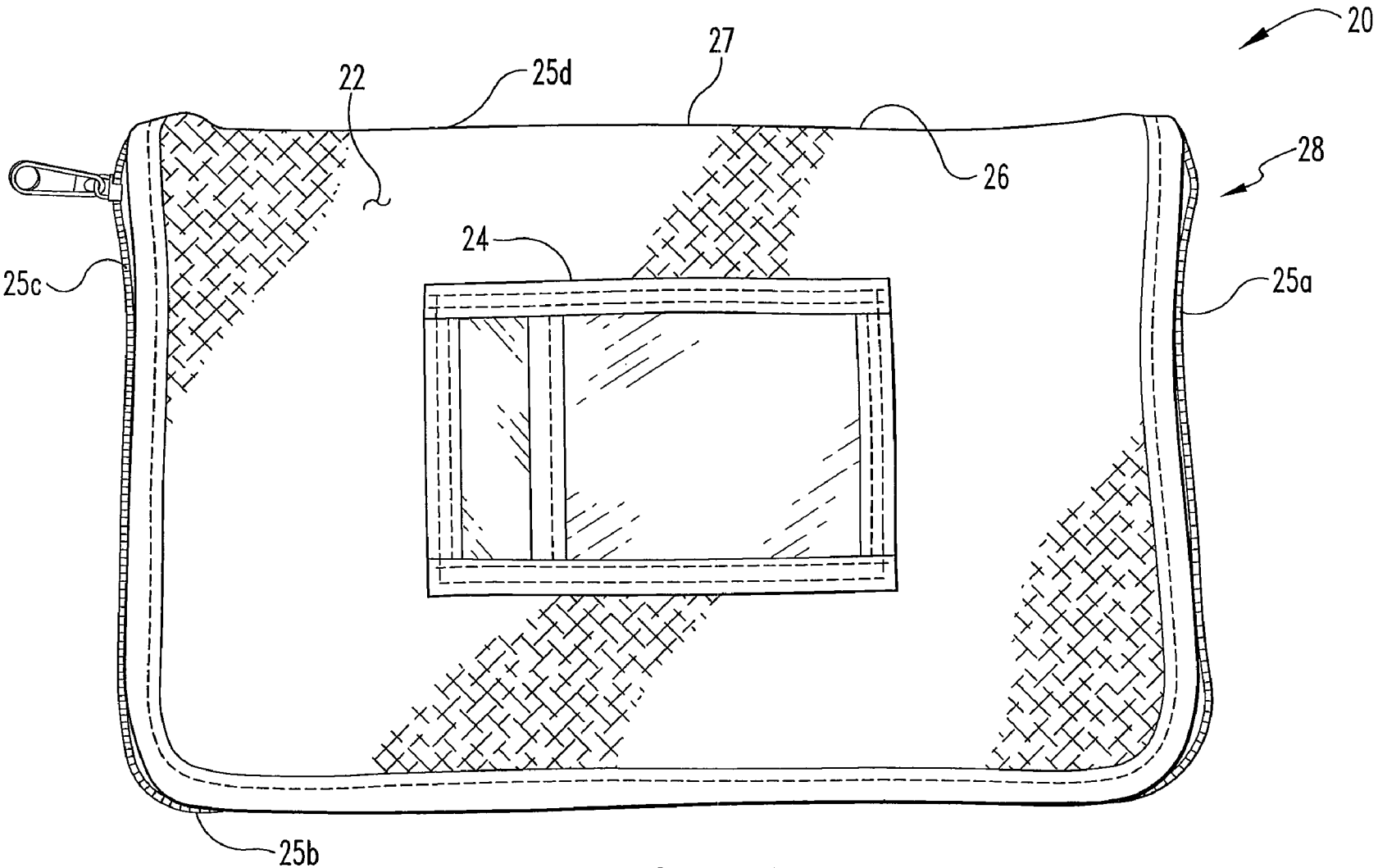
FIG. 1 is a top view of a case according to an embodiment of the present invention.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring generally to FIG. 1, there is shown a case 20 for maintaining insignia and other articles related to a uniform, such as rank, patches, badges, nametags, pins, as examples. Case 20 includes an outside cover having a front outer surface 22 with a pocket 24, and a back outer surface 26 (see FIGS. 2 and 3). In certain embodiments, pocket 24 includes a clear front covering and is configured and sized to receive a business card or other such similar identification card. As illustrated, case 20 is configured to fold such that outer surfaces 22 and 26 are separated by an outer fold portion 27. Front surface 22 and back surface 26 may be connected together via a zipper assembly 28. In certain embodiments, zipper assembly 28 zips along three sides of front surface 22 and back surface 26 creating edges 25*a*, 25*b*, and 25*c* of case 20. Additionally, the folding of case 20 at outer fold portion 27 creates an edge 25*d* and an inner fold portion on the inside of the case.

In the illustrated embodiment, case 20 is generally rectangular in shape, however it should be appreciated that the case can be shaped differently as would occur to one skilled in the art. Additionally, front surface 22 and back surface 26 can be made of a cloth material, or other such appropriate type of material. In other embodiments, front surface 22 and back surface 26 are made of a plastic material.

Figure 2:
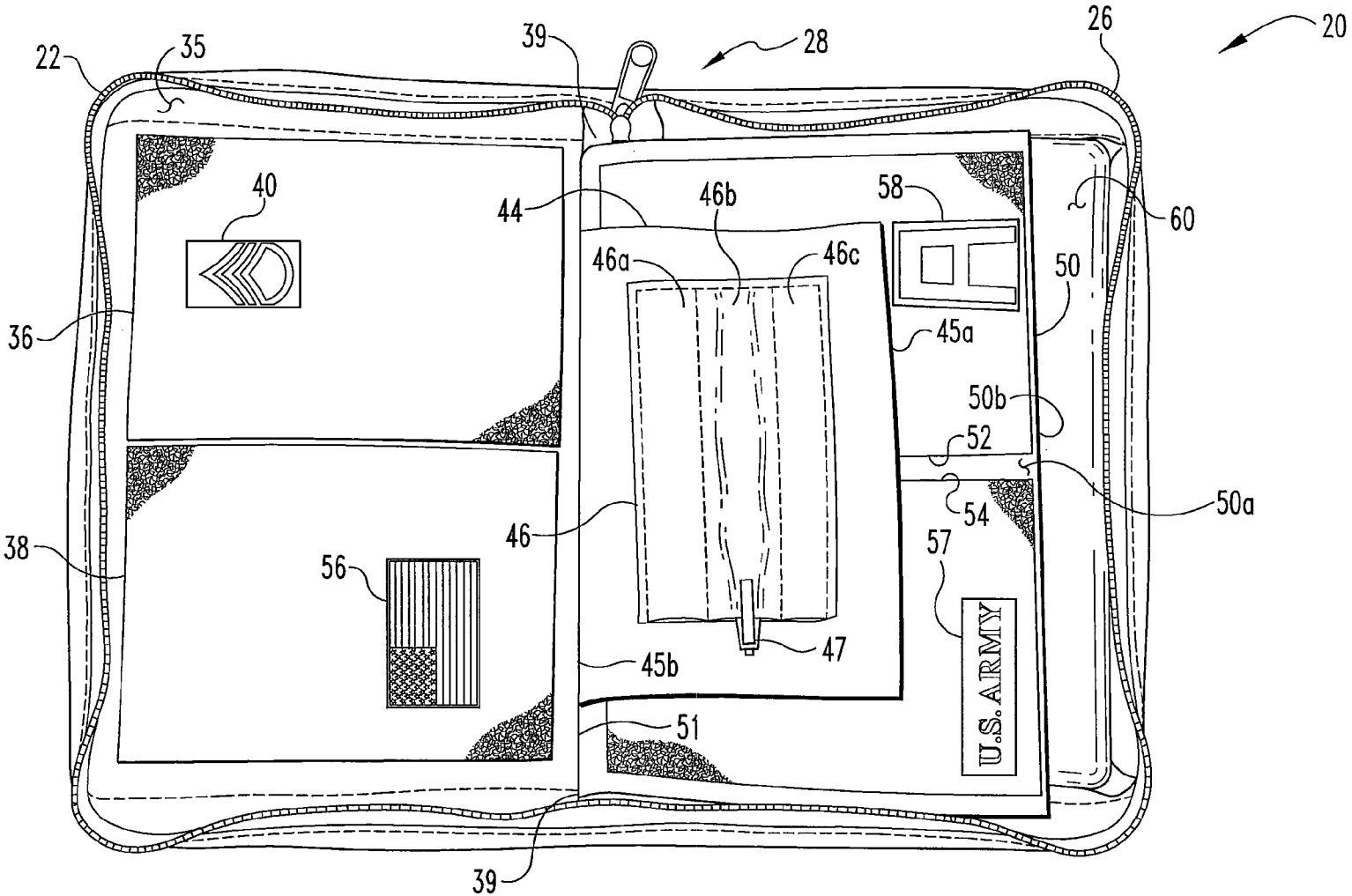
FIG. 2 is a top view of a case according to an embodiment of the present invention.

FIG. 2 illustrates case 20 in an unzipped and opened position. Case 20 includes inside front cover surface 35 and an inside back cover surface 60 separated by an inner fold portion 39. In the illustrated embodiment, surface 35 includes hook and loop fastener sections or attachment pieces 36 and 38. In certain embodiments, pieces 36 and 38 can be made of Velcro®. Pieces 36 and 38 can hold insignia or other types of items, such as badge 40 for example. Additionally, in certain embodiments, the items attached to pieces 36 and 38 are also made of Velcro®. In the illustrated embodiment, pieces 36 and 38 are sewn to surface 35. However, it should be appreciated that pieces 36 and 38 can be attached to surface 35 in other appropriate manners. In the illustrated embodiment there are two pieces 36 and 38, however it should be appreciated that the hook and loop fastener pieces can number more or less than two and/or could cover more or less area on inside front cover surface 35.

Additionally, case 20 includes a pouch 44. Pouch 44 can be used to hold pins, pens, coins or other such loose items associated to a uniform. Pouch 44 closes at top edge 45*a* via a zipper, snaps, Velcro® or other such fastening mechanism. Pouch 44 can be attached to case 20 adjacent inner fold portion 39 along edge or side 45*b* of pouch 44 and can flip like the page of a book between inside front cover surface 35 and inside back cover surface 60. Additionally, pouch 44 can include a pocket 46 on an outer surface thereof. Pocket 46 can be formed by attaching a piece of material on three sides to an outer surface of pouch 44. Pocket 46 can also be sewn to an outer surface of pouch 44 along various lines to form slots, such as slots 46*a*, 46*b*, and 46*c*. The slots 46*a-c* can be used to hold items, such as pen 47, for example. It should be appreciated that pocket 46 can be placed else where on case 20, including the opposing outer surface of pouch 44 for example, or another surface of case 20 as would occur to one skilled in the art. Additionally, there can be more pouches 44 and/or pockets 46 on the inside of case 20. In other embodiments, pouch 44 and/or pocket 46 could be absent.

Figure 3:
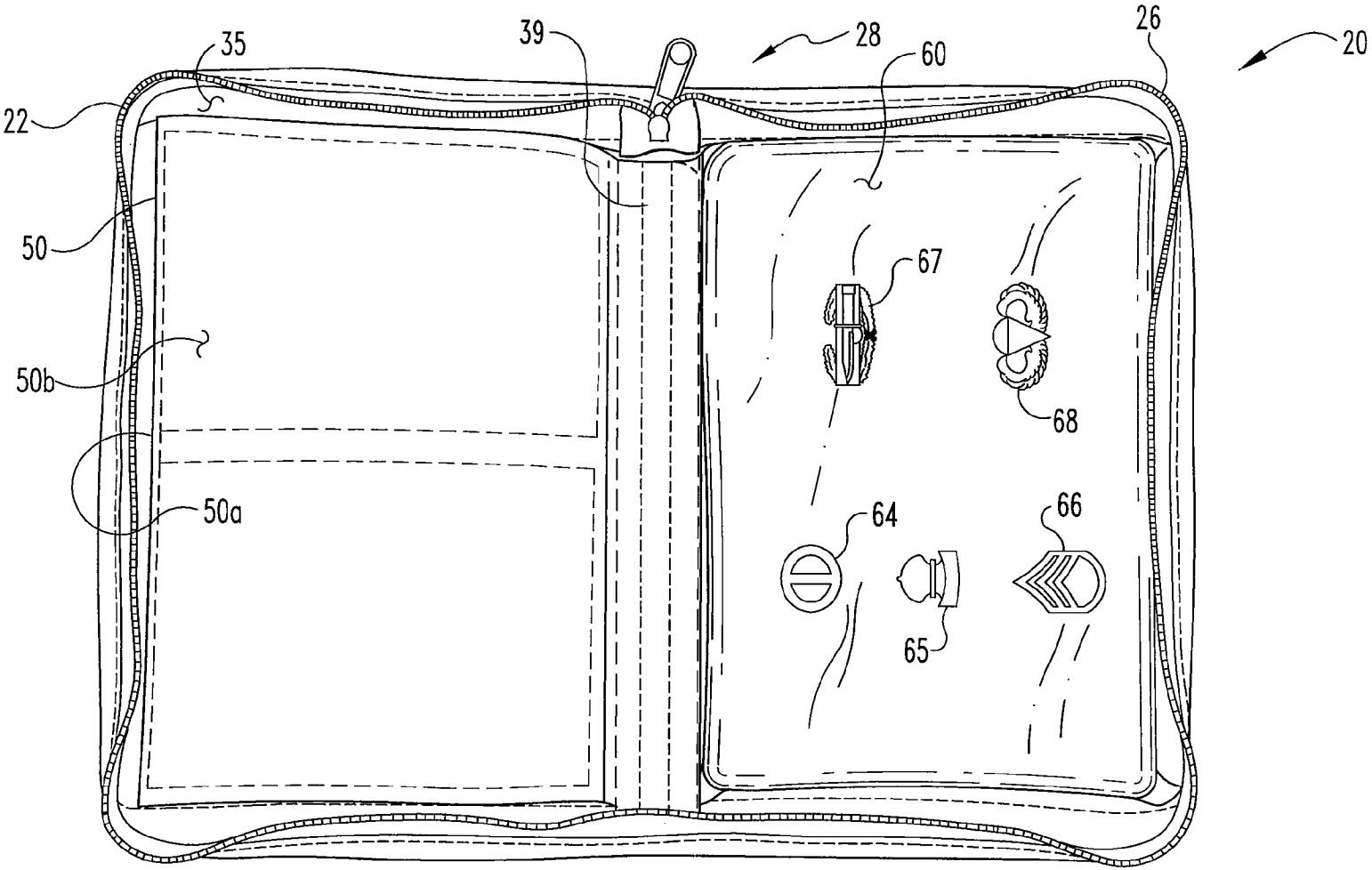
FIG. 3 is a top view of a case according to an embodiment of the present invention.

Case 20 includes an inner panel or flap 50 having a first side 50*a* and an opposing second side 50*b* (see FIG. 3). In certain embodiments, flap 50 can be attached to case 20 adjacent inner fold portion 39 along edge or side 51 of flap 50 and can also flip between inside front cover surface 35 and inside back cover surface 60. In the illustrated embodiment, flap 50 includes hook and loop fastener attachment pieces 52 and 54 attached thereto. In the illustrated embodiment, pieces 52 and 54 are sewn to first side 50*a* of flap 50, however the pieces could be attached to flap 50 in other manners as is known in the art. In certain embodiments, pieces 52 and 54 are made of a Velcro® material. In such embodiments, pieces 52 and 54 can be used to hold Velcro® insignia, such as badges 56, 57 and 58 as examples.

FIG. 3 illustrates case 20 in a position in which flap 50 is positioned adjacent inside front cover surface 35, showing second side 50*b* of flap 50. In certain embodiments, second side 50*b* of flap 50 can be used to hold pins. Additionally, in other embodiments, second side 50*b* can include hook and loop fastener attachment pieces, as does first side 50*a* in the illustration of FIG. 2. As illustrated, inside back cover surface 60 can be used to hold items such as pins 64-68, as examples. In certain embodiments, a piece of material such as polystyrene foam, for example, is inserted between back surface 26 and inside back cover surface 60 to receive the pins.

The various surfaces within case 20 create a plurality of attachment surfaces for attaching articles associated with a uniform. It should be appreciated that the hook and loop fastener attachment piece(s) or section(s), the flap(s), the pocket(s), the pouch(es), and the foam backing(s) of case 20 could be positioned else where in the case than as illustrated. As examples, one or more hook and loop fastener attachment pieces of varying sizes could be attached to second side 50*b* of case 20 and/or inside back cover surface 60. Additionally, there can be more flaps, such as flap 50, on the inside of case 20, and/or flap 50 could be absent in certain embodiments. Moreover, in certain embodiments, a surface of case 20 could include hook and loop fastener attachment pieces as well as be used to receive pins. In certain embodiments, case 20 is of an appropriate size to enable convenient transport and carrying of the case. Additionally, in certain embodiments, case 20 is configured and organized such that insignia and other items removed from a uniform can be secured in case 20 in the order that they are removed and placed back on a uniform.

In the illustrated embodiment, case 20 is used in conjunction with a military uniform, as an example. However, it should be appreciated that case 20 can be used with any other type of uniform having insignia, badges and other items or articles to be removed in certain situations. Additionally, in certain embodiments, case 20 can be used in conjunction with a uniform to be laundered in which items must be removed from the uniform before laundering.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A case for maintaining articles related to a uniform, comprising:

an outer cover including an outer fold portion between first and second outer cover surfaces;

a zipper connecting said outer cover surfaces along three sides;

first and second inner cover surfaces, opposite said first and second outer cover surfaces, respectively, said inner cover surfaces being separated by an inner fold portion opposite said outer fold portion;

wherein at least one of said inner cover surfaces includes at least one attachment piece having hook and loop fasteners configured to receive at least one uniform article having hook and loop fasteners;

at least one foam piece positioned between at least one of said inner cover surfaces and said corresponding outer cover surface, wherein said foam piece and said corresponding inner cover surface are configured to receive at least one uniform pin;

an inner flap attached to said inner fold portion and positioned between said inner cover surfaces, wherein said inner flap includes first and second sides facing said first and second inner cover surfaces, respectively, wherein said inner flap includes at least one attachment piece on at least one of said sides having hook and loop fasteners configured to engage at least one uniform article having hook and loop fasteners; and an inner pouch attached to said inner fold portion to maintain loose items, said pouch being positioned between said inner cover surfaces and having two opposing outer surfaces, wherein at least one of said outer surfaces includes at least one pocket positioned thereon.

2. The case of claim 1, wherein said inner pouch includes a closure mechanism having hook and loop fasteners to selectively close said pouch.

3. The case of claim 1, wherein said pocket on said inner pouch is configured to receive a writing instrument.

4. The case of claim 1, comprising a front pocket positioned on one of said outer cover surfaces configured to receive an identification card, wherein said front pocket includes a transparent outer covering.

5. The case of claim 1, wherein said at least one attachment piece on said corresponding inner cover surface is sewn to said corresponding inner cover surface.

6. The case of claim 1, wherein said at least one attachment piece on said inner flap is sewn to said corresponding side of said inner flap.

7. The case of claim 1, wherein said inner flap and said inner pouch are sewn to said inner fold portion.

8. The case of claim 1, wherein said foam piece is composed of polystyrene foam.

* * * * *